US005508943A

United States Patent [19]

Batson et al.

[11] Patent Number: 5,508,943

[45] Date of Patent: Apr. 16, 1996

[54] METHOD AND APPARATUS FOR MEASURING THE DISTANCE OF A TURBOCOMPRESSOR'S OPERATING POINT TO THE SURGE LIMIT INTERFACE

[75] Inventors: Brett W. Batson, Dallas Center; Krishnan Narayanan, Ankeny, both of Iowa

[73] Assignee: Compressor Controls Corporation, Des Moines, Iowa

[21] Appl. No.: 225,448

[22] Filed: Apr. 7, 1994

[51] Int. Cl.[6] ..... F04D 17/14

[52] U.S. Cl. ..... 364/551.01; 415/1; 364/431.02

[58] Field of Search ..... 364/551.01, 431.02; 415/1, 17, 26, 27

[56] References Cited

U.S. PATENT DOCUMENTS

| | | | |
|---|---|---|---|
| 4,156,578 | 5/1979 | Agar et al. | 415/1 |
| 4,831,534 | 5/1989 | Blotenberg | 364/431.02 |
| 4,831,535 | 5/1989 | Blotenberg | 364/431.02 |
| 4,944,652 | 7/1990 | Botenberg | 415/27 |
| 4,949,276 | 8/1990 | Staroselsky et al. | 364/509 |
| 4,971,516 | 11/1990 | Lawless et al. | 415/1 |
| 5,306,116 | 4/1994 | Gunn et al. | 415/27 |

OTHER PUBLICATIONS

Reprint entitled "Improved Surge Control for Centrifugal Compressors" by N. Staroselsky and Lawrence Ladin, Chemical Engineering, May 21, 1979.

Article entitled "Surge Control for Centrifugal Compressors" by M. W. White (The Foxboro Co.), Chemical Engineering, Dec. 25, 1972.

Technical Information on Compressor Surge Control, by J. Agar Instrumentation Ltd, Alresford, Hampshire, England, Jun. 1, 1977.

Article entitled "Turbocompressor Antisurge Control, New Solution for An Old Problem" by John R. Gaston of the Dresser–Rand Company at the International Gas Turbine and Aeroengine Congress & Exposition, Jun. 1–4, 1992.

Article entitled "Reasons for Centrifugal Compressor Surging and Surge Control" by A. Kolnsberg, Journal of Engineering for Power, Jan. 1979, vol. 101.

Article entitled "Turbomachinery in Base Load Natural Gas Liquefaction Plants" by J. P. Naegeli, A. Spechtenhausen & W. Aicher at the 12th World Gas Conference 73.

Article entitled "Compressor Surge Control" by F. Gupta and Clarence C. Teague of Fluor Engineers and Constructors, Inc. Santa Ana, California, Jan. 1977.

Article entitled "Optimize Centrifugal Compressor Performance" by B. P. Gupla and M. F. Jeffrey, Hydrocarbon Processing, Jun. 1979.

69–page brochure dated Dec., 1993 and entitled Series 3 Plus Antisurge Controller for Centrifugal and Axial Compressors . . . by Compressor Controls.

Ralph L. Moore, "Control of Centrifugal Compressors"; 1989; Unit 6 (starting on p. 123); § 6–5 on p. 137; and FIG. 6–12 (p. 141).

*Primary Examiner*—Ellis B. Ramirez
*Assistant Examiner*—Patrick Assouad
*Attorney, Agent, or Firm*—Henderson & Sturm

[57] ABSTRACT

A method and apparatus are disclosed for protecting turbocompressors from unstable flow conditions (surge and stall). To accomplish this, it is necessary to easily and accurately calculate a compressor's operating point and its distance from the interface between the surge region and the stable region—this interface is referred to as the Surge Limit Interface. The proximity of the operating point to the Surge Limit Interface is calculated using measurements of properties throughout the compressor-process system. It is crucial that the calculation be invariant to suction conditions, especially gas composition. Disclosed are three coordinates, $T_r$ (reduced torque), $P_r$(reduced power), and $N_e$(equivalent speed). Each of these can be combined with other invariant parameters to construct coordinate systems in which to define the Surge Limit Interface and measure the distance of the operating point to that interface.

96 Claims, 6 Drawing Sheets

FUNDAMENTAL COORDINATES WITHOUT INLET GUIDE VANES

| $\frac{T_r}{k_s}$ | $\frac{P_r}{k_s}$ | $\frac{h_r}{k_s}$ | $R_c$ | $\frac{q_s^2}{k_s}$ | $\frac{N_e^2}{k_s}$ |
|---|---|---|---|---|---|
| | ● | | ● | | |

TABLE I

FUNDAMENTAL COORDINATES WITH INLET GUIDE VANES

| $\frac{T_r}{k_s}$ | $\frac{P_r}{k_s}$ | $\frac{h_r}{k_s}$ | $R_c$ | $\frac{q_s^2}{k_s}$ | $\frac{N_e^2}{k_s}$ | $\alpha$ |
|---|---|---|---|---|---|---|
| | ● | | ● | | | ● |

TABLE 2

Table 3: Fundamental Coordinates-Without Inlet Guide Vanes

| $\frac{T_r}{k_s}$ | $\frac{P_r}{k_s}$ | $\frac{h_r}{k_s}$ | $R_c$ | $\frac{q_s^2}{k_s}$ | $\frac{N_e^2}{k_s}$ |
|---|---|---|---|---|---|
| ● | | ● | | | |
| ● | | | ● | | |
| ● | | | | ● | |
| ● | | | | | ● |
| | ● | ● | | | |
| | ● | | ● | | |
| | ● | | | ● | |
| | ● | | | | ● |
| | | ● | | | ● |
| | | | ● | | ● |
| | | | | ● | ● |

Table 4: Fundamental Coordinates-With Inlet Guide Vanes

| $\frac{T_r}{k_s}$ | $\frac{P_r}{k_s}$ | $\frac{h_r}{k_s}$ | $R_c$ | $\frac{q_s^2}{k_s}$ | $\frac{N_e^2}{k_s}$ | $\propto$ |
|---|---|---|---|---|---|---|
| ● | | ● | | | ● | |
| ● | | ● | | | | ● |
| ● | | | ● | | ● | |
| ● | | | ● | | | ● |
| ● | | | | ● | ● | |
| ● | | | | ● | | ● |
| | ● | ● | | | ● | |
| | ● | ● | | | | ● |
| | ● | | ● | | ● | |
| | ● | | ● | | | ● |
| | ● | | | ● | ● | |
| | ● | | | ● | | ● |
| | | ● | | ● | ● | |
| | | ● | | ● | | ● |
| | | | ● | ● | ● | |
| | | | ● | ● | | ● |

Fig. 6

METHOD AND APPARATUS FOR MEASURING THE DISTANCE OF A TURBOCOMPRESSOR' S OPERATING POINT TO THE SURGE LIMIT INTERFACE

TECHNICAL FIELD

This invention relates to a method for protecting turbocompressors from adverse surges and stalls, specifically by utilizing sets of coordinates which are invariant to inlet conditions. And it is concerned with measuring distance from a turbocompressor's operating point to the Surge Limit Interface.

BACKGROUND ART

Unstable or oscillatory flow conditions within a turbocompressor, known as surge and stall, are detrimental to process machinery and to the overall process operation. The proximity of the compressor to these unfavorable conditions is detected by process monitoring apparatuses that interact with control algorithms which regulate compressor flow rates within a stable operating region, thus avoiding surge and stall.

Surge control is initiated by analog input signals emanating from various sources located throughout the compressor-process system. Although these signals are many, the set used must consist of relevant data to initiate control-algorithm response (by recirculating or blowing off some of the process gas) to any disturbance before the process flow rate reaches a surge condition.

Prior art surge control can be divided into two categories: surge parameters which are invariant to inlet conditions, and those parameters which are not. Invariant parameters in the prior art consist of different combinations of reduced flow and pressure ratio; or combinations of volumetric flow divided by rotational speed, and polytropic head divided by rotational speed squared. The calculation of these parameters requires knowledge of at least the pressures at the suction and discharge of the turbocompressor, and a flow measurement ($\Delta p_o$). One advantage of the present invention is that it is not limited to this combination of transmitter signals. Control strategies can be implemented using, for instance, a power measurement, suction pressure, and discharge pressure. Furthermore, the concept of this invention can be applied to the detection of fault and fallback strategies, which will keep the turbocompressors running under adverse circumstances.

Of the second category of parameters (those not invariant), some are based on the same pressure and flow measurements as the first category, while others utilize a power or rotational speed measurement as a replacement for flow or discharge pressure measurement. Thus, a control scheme can be applied even if the turbocompressor lacks a flow or discharge pressure measurement. The advantage of the present invention over this prior art is that it does not require that corrections be made for changing inlet conditions.

Thus, there is a need for a method of surge control that provides the flexibility of having a multiplicity of control strategies, together with fault checking and fallback. There is also a need for a surge control system, invariant to inlet conditions, that can accommodate compressor-process systems which are not fully instrumented or have faulty transmitters. A typical turbocompressor performance map (FIG. 5) will depict a surge region (zone) and a stable operating region that are separated by a sharp interface referred to as the Surge Limit Line. Also shown on this map is a Surge Control Line, and the distance between this line and the Surge Limit Line is a safety margin. If the operating point crosses the Surge Control Line, into the safety margin, the antisurge controller calculates a finite error; this error is used in the PI loop. The output of the loop is used to activate an electromechanical sequence in which gas is recycled or blown off to reestablish and maintain a safe flow rate. Should this safety margin be excessive, the frequency and duration of flow recycling will increase, resulting in a reduction of energy efficiency of the compression process. Conversely, should the margin be too brief, the prospect of inadequate protection is amplified.

It is, therefore, obvious that considerable economic advantages can be derived from a narrow margin of safety that incorporates enhanced surge protection with a resultant lessening of process upset. Additional spin-off benefits would: better ensure efficient operation; extend the intervals between scheduled shutdowns; and increase annual monetary savings.

For the foregoing reasons, there is a need to easily and accurately calculate (using invariant coordinate systems) at what point instability occurs under all inlet conditions.

DISCLOSURE OF THE INVENTION

The present invention is directed to a method that satisfies the need to protect turbocompressors from detrimental surges and stalls by the use of various combinations of coordinate systems which are invariant to inlet conditions.

To initiate surge detection and control, it is necessary to easily and accurately calculate a compressor's operating point and its distance from the interface (Surge Limit Interface) between the surge and stable regions using information from the transmitters at hand. Moreover, it is important to be able to calculate this relationship for all inlet conditions—pressure, temperature, molecular weight, compressibility, and specific heat ratio. To protect compressors under varying inlet conditions, one must either construct the Surge Limit Interface in a space which is invariant to these inlet conditions, or be able to correct for them.

Using dimensional analysis, three-dimensional (without inlet guide vanes) and four-dimensional (with inlet guide vanes) coordinate systems are constructed which are invariant to inlet conditions, under the assumption that the Reynolds number is of negligible effect.

The steady state operating point resides on a manifold which is one dimension less than the complete space in which it resides. Thus, for the purpose of control, the problem is reduced to two dimensions when inlet guide vanes are not used, and three dimensions when they are. These coordinate systems (fundamental coordinates), as shown below, yield several possibilities for control; however, linear or nonlinear combinations of the fundamental coordinates are also invariant and can be utilized.

Tables 1 and 2 of FIG. 6 contain three new parameters not found in the prior art: $T_r$ (reduced torque), $P_r$ (reduced power), and $N_e^2$ (equivalent speed), each is divided by $k_s$. Not only are $T_r$ and $P_r$ paired with $N_e^2$, but all three are combined with one or two of the remaining coordinates ($h_r/k_s$, $R_c$, $q_s^2/k_s$, $\alpha$) to formulate a two-dimensional system for turbocompressors without guide vanes, or a three-dimensional system for units with guide vanes.

Since the ratio of specific heats ($k_s$) is presently unmeasurable, it may be assumed to be constant in many instances, without loss of significant accuracy. It may also be calculated from known values when more accuracy is desired.

From these tables of FIG. 6, the coordinate system that provides the most accurate control can be easily chosen. Furthermore, accurate control can be accomplished when the installation lacks certain transmitters such as flow measurement, temperatures, or downstream pressure. Besides providing flexibility for the primary control strategy of a given installation, the above mentioned alternatives provide avenues for fallback strategies in the event of transmitter failure and for fault tolerance.

Additional advantages revealed are that no downstream information is required; accurate control or measurement is certain under varying inlet conditions; and any of the methods can be checked against other methods to improve control integrity.

The basic invariant coordinate systems are based on polytropic head, torque, and power as functions of flow, rotational speed, and inlet guide-vane position. Another coordinate system is presented using pressure ratio instead of polytropic head.

Since power and torque are independent of head and pressure ratio, combinations of power and head, power and pressure ratio, torque and head, or torque and pressure ratio, can be used for control.

BRIEF DESCRIPTION OF THE DRAWINGS

These and other features, aspects, and advantages of the present invention will become better understood with regard to the following description, appended claims, and accompanying drawings where:

FIG. 6 shows two tables of fundamental coordinates: Table 1 shows viable combinations for turbocompressors without inlet guide vanes, and Table 2 for units with inlet guide vanes.

BEST MODES FOR CARRYING OUT THE INVENTION

To protect a turbocompressor from unstable or oscillatory flow conditions (surge or stall) it must be known at what point this instability occurs. There is an interface between a turbocompressor's stable operating region and the region in which it encounters surge or stall; and it is necessary to accurately calculate the operating point and its distance from this interface (Surge Limit Interface).

The operating conditions that are used to calculate the distance from surge or stall are detected by process monitoring (measuring) devices located throughout the compressor-process system.

Figure 1:
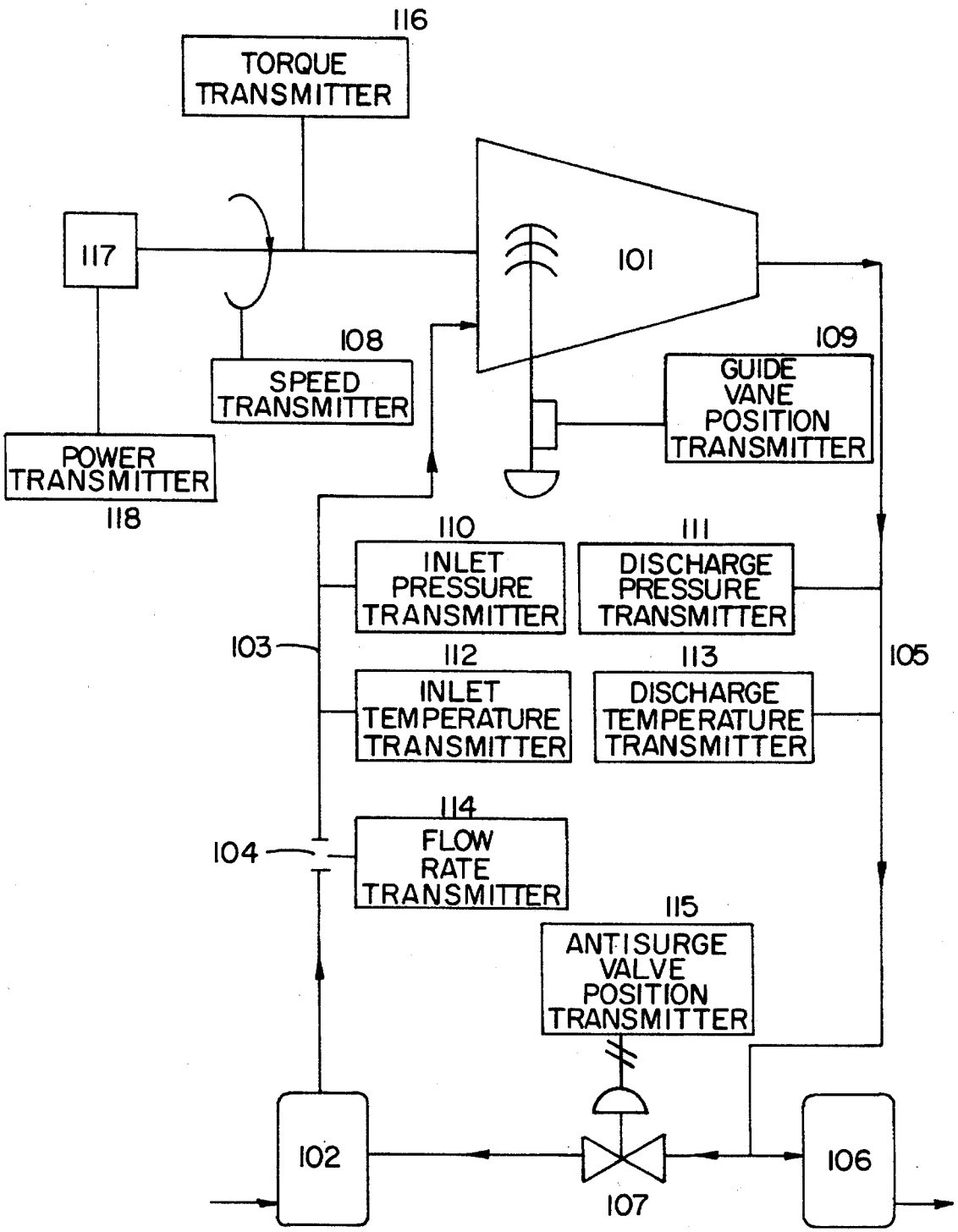
FIG. 1 shows a turbocompressor and its surge protection system (with measuring devices)

FIG. 1 shows a surge protection system (with measuring devices) depicting a turbocompressor 101 pumping gas from a source 102 to an end user 106. Gas enters the compressor through an inlet line 103, into which is installed an orifice plate 104, and leaves by a discharge line 105. Flow is recycled to the source 102 via an antisurge valve 107.

FIG. 1 also illustrates the antisurge control setup and its connections to the compression process. This arrangement includes a rotational speed transmitter 108, a guide vane position transmitter 109, an inlet pressure transmitter 110, a discharge pressure transmitter 111, an inlet temperature transmitter 112, a discharge temperature transmitter 113, a flow rate transmitter 114, (which measures differential pressure across the flow measuring device 104), an antisurge valve position transducer 115, a torque transmitter 116, a driver 117, and a power transmitter 118.

Figure 2:
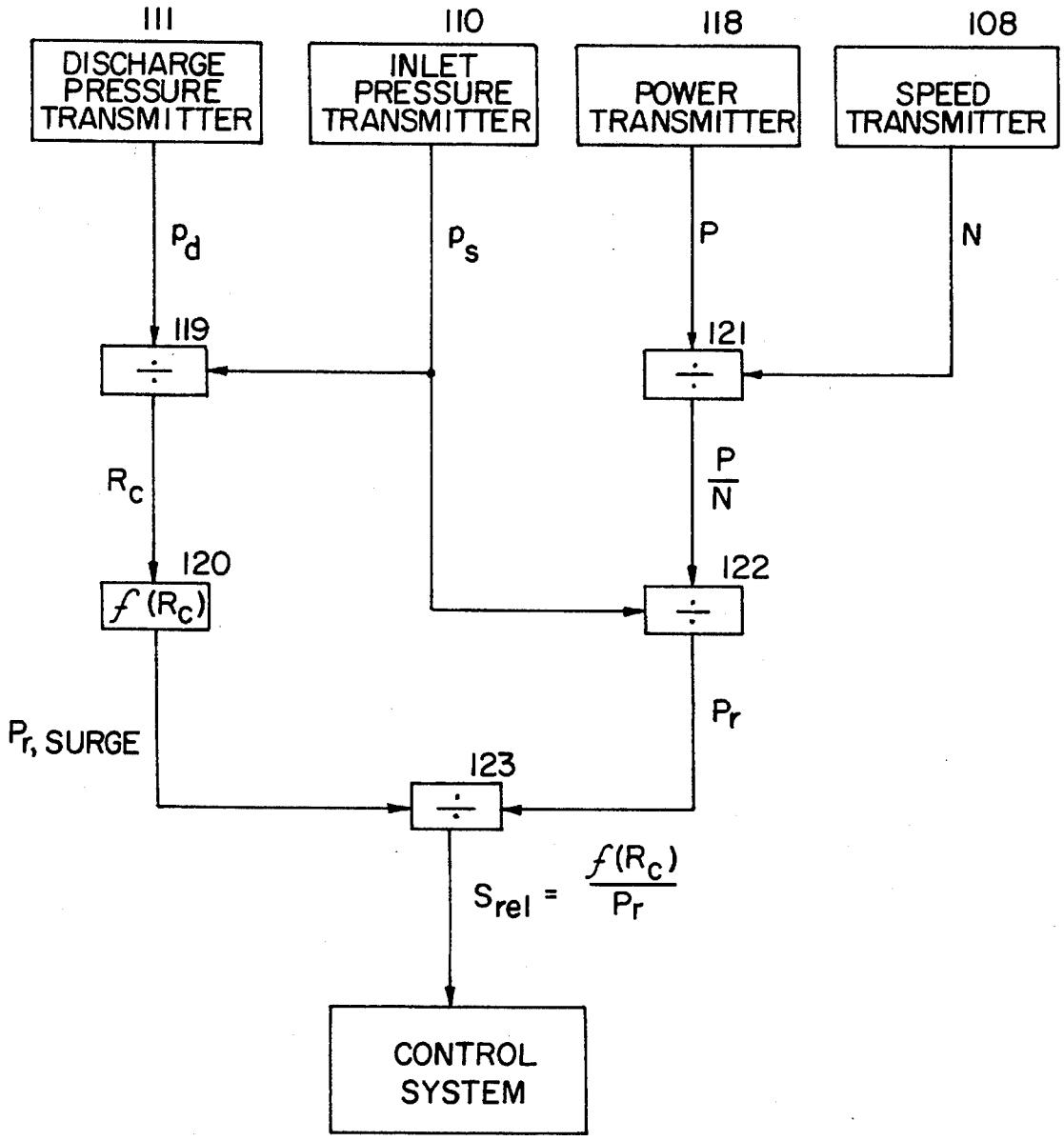
FIG. 2 shows a schematic diagram of a computing-module setup for turbocompressors without inlet guide vanes.
Figure 3:
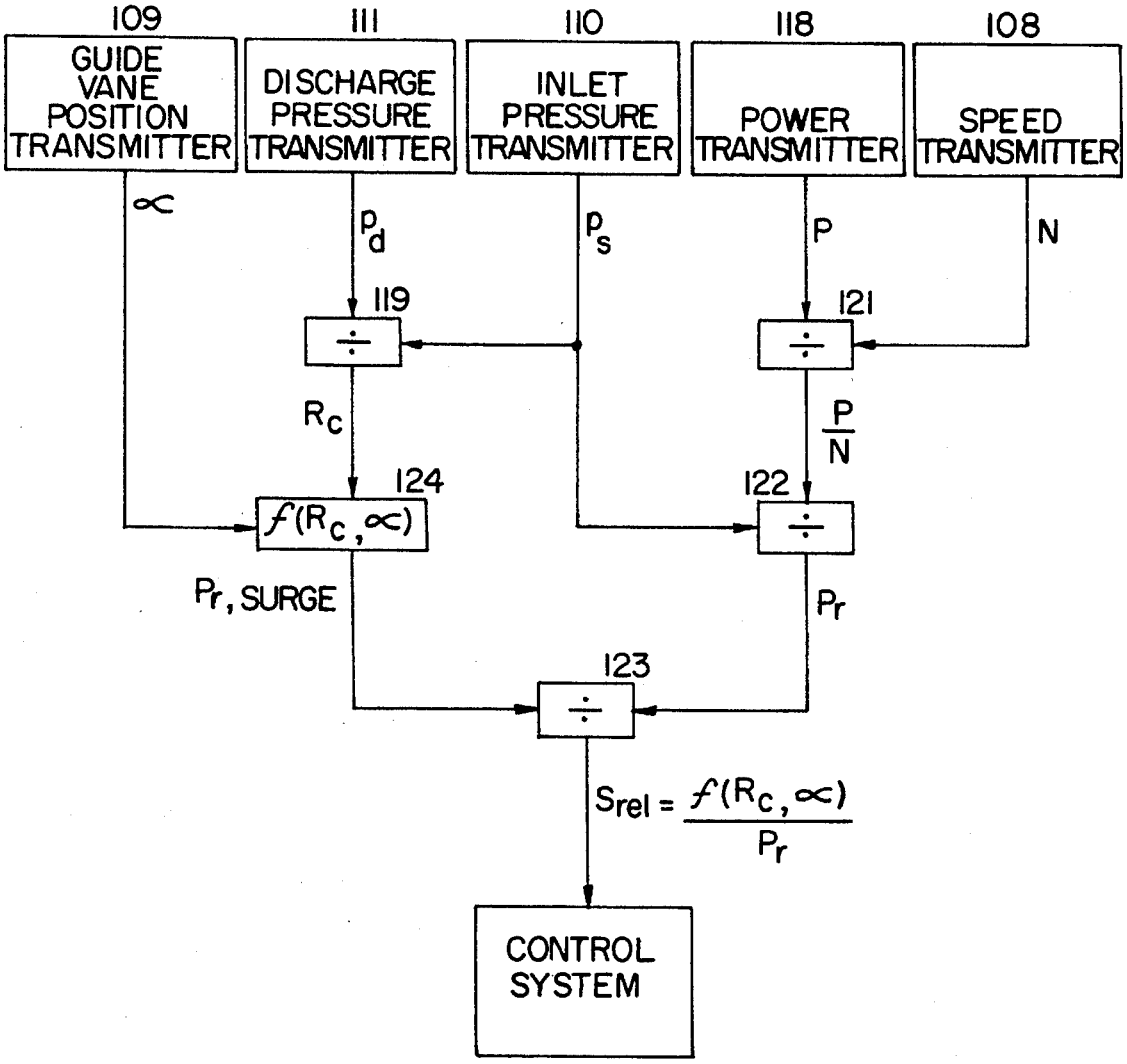
FIG. 3 shows a schematic diagram of a computing-module setup for turbocompressors with inlet guide vanes.

The monitoring equipment of FIG. 1 interacts with those computing modules shown in FIG. 2 and FIG. 3 which, in turn, display schematic diagram setups for turbocompressors without and with inlet guide vanes, respectively. Both assume constant $k_s$.

FIG. 2 illustrates an arrangement for turbocompressors without inlet guide vanes in ($P_r$, $R_c$) coordinates. The equipment includes a module 119 which calculates pressure ratio, as the ratio of discharge pressure to suction pressure; while a module 120 determines reduced power at the surge limit (as a function of pressure ratio). Another module 121 calculates the ratio of power to rotational speed (rpm), the division of this ratio with suction pressure is computed as reduced power by a module 122. And, finally, the relative slope is determined by a module 123, from the ratio of reduced power (at surge) to reduced power. The relative slope information then interacts with a control system to regulate turbocompressor flow rates.

FIG. 3 shows a computing-module arrangement for turbocompressors with inlet guide vanes in ($P_r$, $R_c$, $\alpha$) coordinates. The equipment includes a module 119 which calculates pressure ratio as the ratio of discharge pressure to suction; while a module 124 determines reduced power at the surge limit (as a function of pressure ratio and inlet guide vane angle). Another module 121 calculates the ratio of power to rotational speed (rpm), the division of this ratio with suction pressure is computed as reduced power by a module 122. And, lastly, the relative slope is determined by a module 123, from the ratio of reduced power (at surge) to reduced power. This means that module 123 divides the values of reduced power ($P_r$) into the value of reduced power at surge ($P_{r,surge}$), to determine the relative slope ($S_{rel}$). $P_{r,surge}$ and $f(R_c)$ are the same.

$$S_{rel} = \frac{P_{r,surge}}{P_r} \quad \text{or} \quad \frac{f(R_c)}{P_r}$$

which is the ratio of reduced power at surge to reduced power. The relative slope information then interacts with a control system to regulate turbocompressor flow rates.

Figure 4A:
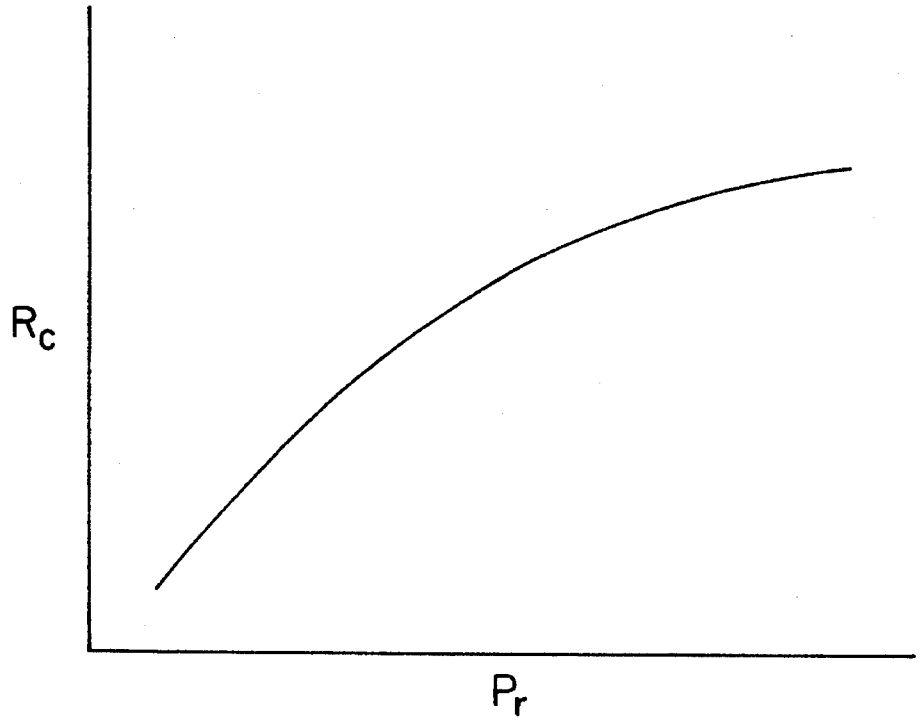
FIG. 4A shows a surge limit line for a turbocompressor without inlet guide vanes in ($P_r$, $R_c$) coordinates.
Figure 4B:
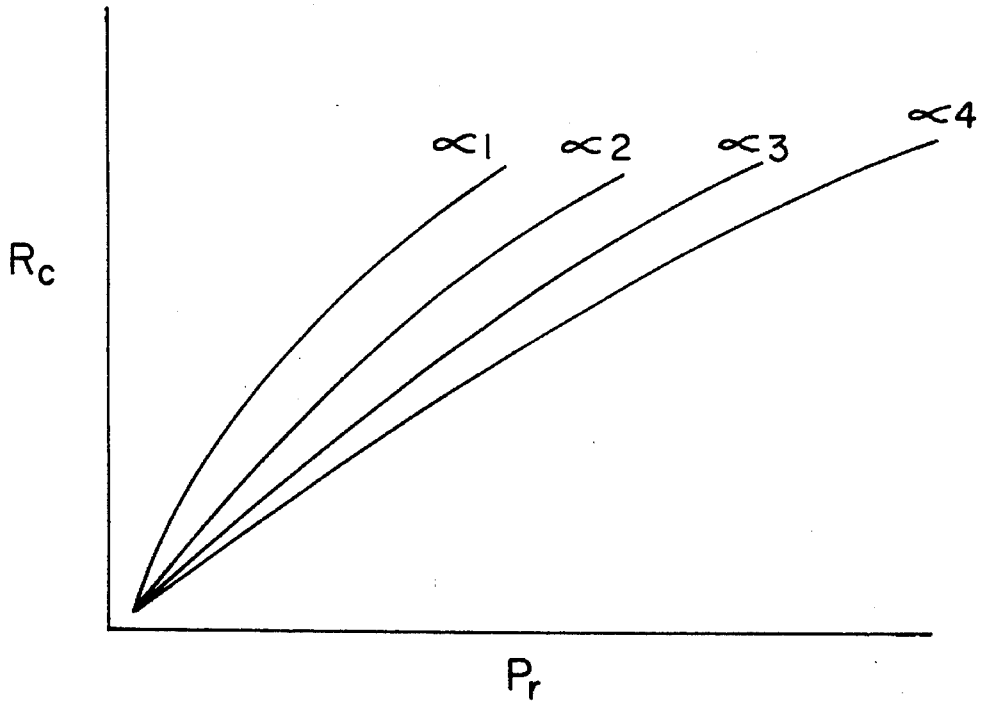
FIG. 4B shows a surge limit line for a turbocompressor with inlet guide vanes in ($P_r$, $R_c$, $\alpha$) coordinates.

FIG. 4A depicts a surge limit line plot for a turbocompressor without inlet guide vanes, in the fundamental coordinates (Table 1) shown on FIG. 2. Likewise, FIG. 4B also depicts a surge limit line plot, but for a turbocompressor with inlet guide vanes, in the fundamental coordinates (Table 2) on FIG. 3.

Figure 5:
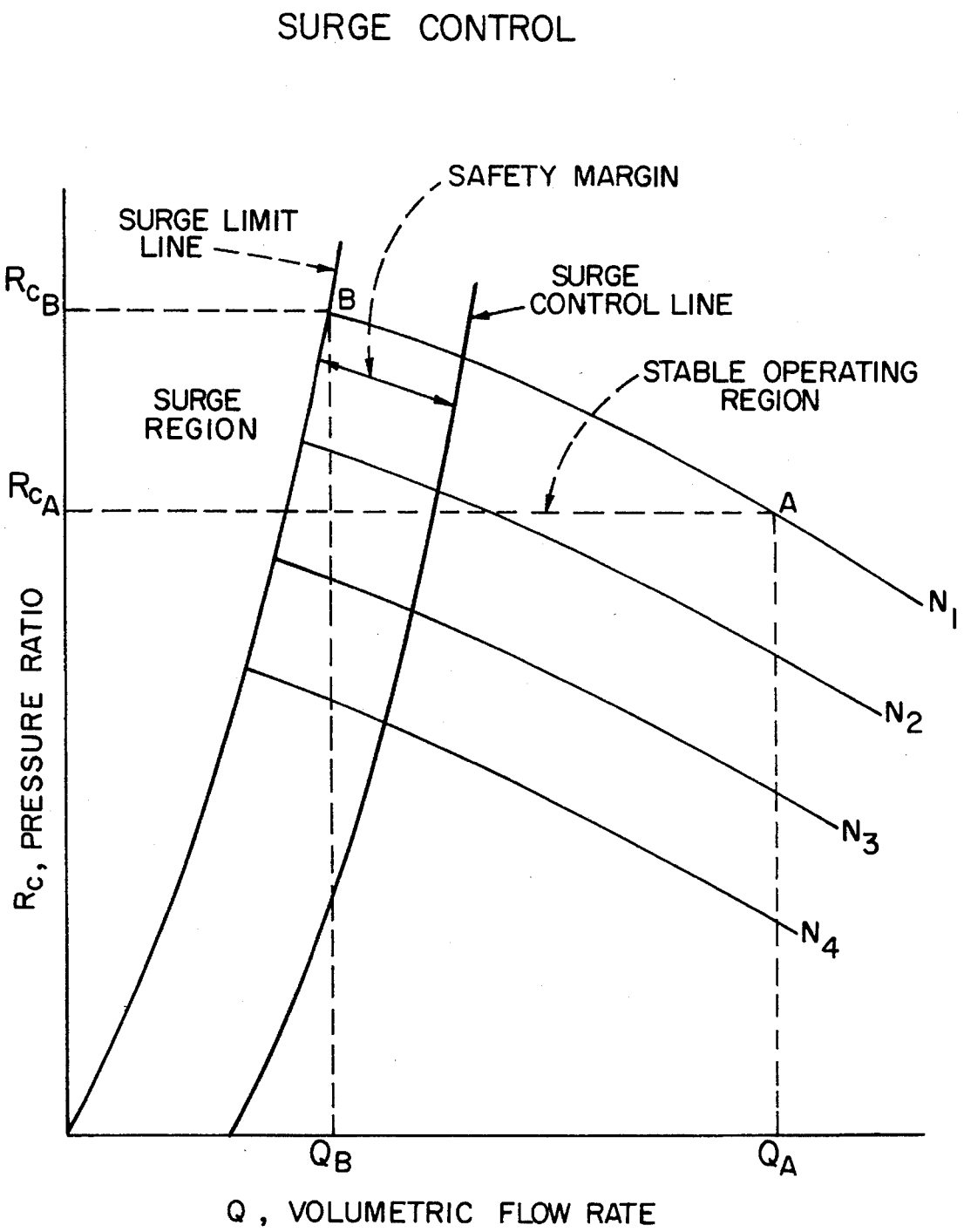
FIG. 5 shows a turbocompressor performance map depicting the different operating regimes.

FIG. 5 shows a turbocompressor performance map which depicts characteristic curves along with the surge limit and control lines that define regions (zones) of operation.

The fundamental coordinate systems (see FIG. 6) are invariant to inlet conditions, and are founded on the theory of dimensional analysis or similitude. Except for inlet guide vane position, this invention focuses exclusively on fixed-geometry compressors.

Tables 3 and 4 of FIG. 6 contain sets of fundamental coordinates for control with and without inlet guide vanes. The sets are combinations of the following:

$T_r$=reduced torque
$h_r$=reduced polytropic head
$q_s$=reduced flow rate in suction
$P_r$=reduced power
$N_e$=equivalent speed
$R_c$=pressure ratio
$\alpha$=inlet guide vane position
$k_s$=ratio of specific heats in suction where;

$$T_r=\frac{T}{p_s}$$

$$h_r=\frac{1}{\sigma}\left[\left(\frac{p_d}{p_s}\right)^{\sigma}-1\right]$$

$$q_s=\sqrt{\frac{\Delta p_{o,s}}{p_s}}$$

$$P_r=\frac{P}{Np_s}$$

$$N_e=\frac{N}{\sqrt{(ZRT)_s}}$$

$$R_c=\frac{p_d}{p_s}$$

$$k=\frac{c_p}{c_v}$$

$$\sigma=\frac{n-1}{n}$$

and;

T=torque
$\sigma$=exponent:
n=polytropic exponent
k=ratio of specific heats
$P_d$=absolute pressure at discharge
$P_s$=absolute pressure in suction
$\Delta p_{o,s}$=A flow measurement signal in suction
P=power
P=pressure
N=rotational speed
Z=compressibility
R=gas constant: $R_u$/MW
R=universal gas constant
MW=molecular weight
T=temperature
s=subscript: suction
r=reduced
$c_p$=specific heat at constant pressure
$c_v$=specific heat at constant volume Although the present invention has been described in detail, and with reference to several possibilities for control, linear or nonlinear combinations of these fundamental coordinates are also invariant and can be used.

An infinite number of coordinate systems can be constructed based on the invariant coordinates presented in the previous sections. Many of these would be viable coordinates for control purposes. These combinations are considered part of the scope of this inventions.

By way of example, consider a compressor without inlet guide vanes. We can construct the compressor map in a coordinate system made up of nonlinear combinations of reduced polytropic head, reduced power, and reduced flow for control. In particular, the map may be constructed in the space:

$$\frac{h_r}{P_r}\text{ versus }\frac{q_r^2}{P_r}$$

This combination may be attractive because it is equivalent to $$\frac{h_r/k_3}{P_r/k_3}\text{ versus }\frac{q_r^2/k_3}{P_r/k_3}$$

which is made up of parameters which are completely invariant to initial conditions—including the ratio of specific heats, $k_3$. The advantage is that, using the form of Equation 1, $k_3$ need not be known at all.

The flow measurement has been referred to as located in suction. Flow measurement in discharge is also acceptable and may be substituted anywhere suction flow measurement appears.

It is therefore to be understood that, within the scope of the appended claims, the invention may be practiced otherwise than as specifically described.

We claim:

1. A method for measuring the distance of a turbocompressor's operating point to a Surge Limit Interface of said turbocompressor, said Surge Limit Interface comprising the locus of points separating the turbocompressor's stable operating region from its unstable region, said method comprising the steps of:

(a) determining said Surge Limit Interface for the turbocompressor as a function of a reduced power parameter, $P_r/k_s=P/k_sNp_s$;

(b) calculating a value that indicates the turbocompressor's operating point as a function of the reduced power parameter, $P_r/k_s$;

(c) comparing the turbocompressor's operating point with said Surge Limit Interface and generating a signal corresponding to the position of the turbocompressor's operating point relative to the turbocompressor's surge point; and (d) controlling the turbocompressor based on said signal.

2. The method of claim 1 wherein the step of comparing the turbocompressor's operating point with the Surge Limit Interface comprises the steps of:

(a) calculating a setpoint at a predetermined position relative to the Surge Limit Interface; and (b) comparing the operating point with the setpoint.

3. The method of claim 1 wherein the Surge Limit Interface is also determined as a function of one of the parameters which include reduced polytropic head ($h_r/k_s$), reduced flow rate ($q_s^2/k_s$), pressure ratio ($R_c$), inlet guide vane position ($\alpha$), and equivalent speed ($N_e^2/k_s$).

4. The method of claim 1 wherein the Surge Limit Interface is also determined as a function of another one of the parameters which include reduced polytropic head ($h_r/k_s$), reduced flow rate ($q_s^2/k_s$), pressure ratio ($R_c$), inlet guide vane position ($\alpha$), and equivalent speed ($N_e^2/k_s$).

5. The method of claim 1 wherein the step of calculating an operating point comprises the steps of:

(a) sensing the power by a power measurement device and generating a power signal proportional to the power;

(b) sensing the suction pressure of the turbocompressor by a pressure transmitter, and generating a suction pressure signal proportional to the suction pressure;

(c) sensing the rotational speed by a speed measuring device and generating a speed signal proportional to the speed;

(d) calculating $P_r=P/Np_s$ from the power signal, suction pressure signal, and the speed signal;

(e) calculating $k_s$ (ratio of specific heats) as a function of known values; and (f) calculating the operating point proportional to the reduced power parameter, $P_r/k_s$.

6. The method of claim 2 wherein the step of calculating a setpoint comprises the steps of:

(a) plotting the Surge Limit Interface as a function of the reduced power parameter, $P_r/k_s$, and one of the following: reduced polytropic head ($h_r/k_s$), reduced flow rate ($q_s^2/k_s$), pressure ratio ($R_c$), inlet guide vane position ($\alpha$), and equivalent speed ($N_e^2/k_s$);

(b) selecting a setpoint reference line; and (c) setting the setpoint on the setpoint reference line at a predetermined position relative to the Surge Limit Interface.

7. The method of claim 6 wherein the step of selecting a setpoint reference line comprises the steps of:

(a) choosing a point on the Surge Limit Interface; and (b) selecting the line described by this point and the operating point.

8. The method of claim 2 wherein the predetermined position of the setpoint, relative to the Surge Limit Interface, is adjustable during operation of the turbocompressor.

9. A method for controlling a turbocompressor having a recycle line between its suction and discharge comprising the steps of:

(a) determining a Surge Limit Interface for the turbocompressor as a function of a reduced power parameter, $P_r/k_s=P/k_sNp_s$, said Surge Limit Interface comprising the locus of points separating the turbocompressor's stable operating region from its unstable region;

(b) calculating the turbocompressor's operating point as a function of the reduced power parameter, $P_r/k_s$;

(c) comparing the turbocompressor's operating point with said Surge Limit Interface to determine the position of the turbocompressor's operating point relative to the turbocompressor's surge point;

(d) generating a control signal corresponding to the position of the turbocompressor's operating point relative to the turbocompressor's surge point; and (e) modulating flow through the recycle line in response to the control signal so as to avoid surging of the turbocompressor.

10. The method of claim 9 wherein the step of comparing the turbocompressor's operating point with the turbocompressor's surge point comprises the steps of:

(a) calculating a setpoint at a predetermined position relative to the Surge Limit Interface; and (b) comparing the operating point with the setpoint.

11. The method of claim 9 wherein the Surge Limit Interface is determined also as a function of another one of the following: reduced polytropic head ($h_r/k_s$), reduced flow rate ($q_s^2/k_s$), pressure ratio ($R_c$), inlet guide vane position ($\alpha$), and equivalent speed ($N_e^2/k_s$).

12. The method of claim 9 wherein the step of calculating an operating point comprises the steps of:

(a) sensing the power by a power measuring device and generating a power signal proportional to the power;

(b) sensing the suction pressure of the turbocompressor by a pressure transmitter, and generating a suction pressure signal proportional to the suction pressure;

(c) sensing the rotational speed by a speed measuring device and generating a speed signal proportional to the speed;

(d) calculating $k_s$ as a function of known values;

(e) calculating $P_r=P/Np_s$ from the power signal, suction pressure signal, and the speed signal; and (f) calculating the operating point proportional to the reduced power parameter, $P_r/k_s$.

13. The method of claim 10 wherein the step of calculating a setpoint comprises the steps of:

(a) plotting the Surge Limit Interface as a function of the reduced power parameter, $P_r/k_s$, and another one of the following: reduced polytropic head ($h_r/k_s$), reduced flow rate ($q_s^2/k_s$), pressure ratio ($R_c$), inlet guide vane position ($\alpha$), and equivalent speed ($N_e^2/k_s$);

(b) selecting a setpoint reference line; and (c) setting the setpoint on the setpoint reference line at a predetermined position relative to the Surge Limit Interface.

14. The method of claim 13 wherein the step of selecting a setpoint reference line comprises the steps of:

(a) choosing a point on the Surge limit Interface; and (b) selecting the line described by this point and the operating point.

15. The method of claim 10 wherein the predetermined position of the setpoint relative to the Surge Limit Interface is adjustable during operation of the turbocompressor.

16. A method for controlling a turbocompressor having a recycle line between its suction and discharge, comprising the steps of:

(a) determining a Surge Limit Interface for the turbocompressor that is a function of the reduced power parameter, $P_r/k_s=P/k_sNp_s$, and one or more of the following: reduced polytropic head ($h_r/k_s=[(p_d/p_s)^{\sigma}-1]/k_s\sigma$), reduced flow rate ($q_s^2/k_s=\Delta p_{o,s}/k_sp_s$), pressure ratio ($R_c=p_d/p_s$), inlet guide vane position ($\alpha$), and equivalent speed ($N_e^2/k_s=N^2/(kZRT)_s$), said Surge Limit Interface comprising the locus of points separating the turbocompressor's stable operating region from its unstable region;

(b) sensing the power by a power measuring device and generating a power signal proportional to the power;

(c) sensing the suction pressure of the turbocompressor and generating a suction pressure signal proportional to the suction pressure;

(d) sensing the rotational speed by a speed measuring device and generating a speed signal proportional to the speed;

(e) calculating $P_r$ from the power signal, suction pressure signal, and the speed signal;

(f) calculating $k_s$ as a function of known values;

(g) calculating a value proportional to the reduced power parameter, $P_r/k_s$;

(h) calculating a value for a second parameter as a function of another one of $h_r/k_s$, $q_s^2/k_s$, $R_c$, $\alpha$, or $N_e^2/k_s$;

(i) comparing the reduced power parameter, $P_r/ks$, and the second parameter with the Surge Limit Interface to generate a control signal corresponding to the position of the turbocompressor's operating point relative to the turbocompressor's surge point; and (j) modulating flow in the recycle line in response to the control signal so as to avoid surging of the turbocompressor.

17. The method of claim 16 wherein determination of the Surge Limit Interface comprises the steps of:

(a) calculating a value proportional to the reduced power parameter, $P_r/k_s$;

(b) calculating a value for a second parameter as a function of one of $h_r/k_s$, $q_s^2k_s$, $R_c$, $\alpha$, or $N_e^2/k_s$;

(c) calculating a value for a third parameter as a function of another one of $h_r/k_s$, $q_s^2/k_s$, $R_c$, $\alpha$, or $N_e^2/k_s$; and (d) comparing the reduced power parameter, $P_r/k_s$, and the second and third parameters with the Surge Limit Interface to generate a control signal corresponding to the position of the turbocompressor's operating point relative to the turbocompressor's surge point.

18. The method of claim 16 wherein the step of comparing the reduced power parameter, $P_r/k_s$, and the other parameters with the Surge Limit Interface comprises the steps of:

(a) establishing a setpoint reference line;

(b) selecting a setpoint on the setpoint reference line at a predetermined position relative to the Surge Limit Interface;

(c) calculating a value representing the operating point to the turbocompressor along the setpoint reference line; and (d) comparing the operating point with the setpoint.

19. The method of claim 18 wherein the step of selecting a setpoint reference line comprises the steps of:

(a) choosing a point on the Surge Limit Interface; and (b) selecting the line described by this point and the operating point.

20. The method of claim 15 wherein the step of calculating a value proportional to the reduced power parameter, $P_r/k_s$, comprises the steps of:

(a) dividing the rotational speed signal into the power signal to generate a P/N value;

(b) dividing P/N by the suction pressure signal, $p_s$, to generate a $P/Np_s$ value which is proportional to $P_r$;

(c) calculating $k_s$ from known values; and (d) dividing $P_r$ by $k_s$ to generate a value which is proportional to the reduced power parameter, $P_r/k_s$.

21. The method of claim 16 wherein the step of comparing the reduced power parameter, $P_r/k_s$, and said second parameter with the Surge Limit Interface comprises the steps of:

(a) calculating a setpoint at a predetermined position relative to the Surge Limit Interface;

(b) generating an operating point that is a function of the reduced power parameter, $P_r/k_s$, and said second parameter; and (c) comparing the operating point with the setpoint.

22. The method of claim 21 wherein the operating point is a function of the ratio of the reduced power parameter, $P_r/k_s$, to the second parameter, multiplied by a function of a third parameter.

23. The method of claim 22 wherein the operating point is the reduced power parameter, $P_r/k_s$, divided by the second parameter, multiplied by a function of the third parameter (if existing) minus one, the second value modified to properly characterize the first signal in relation to the Surge Limit Interface.

24. An apparatus for determining the position of a turbocompressor's operating point relative to the turbocompressor's surge point, comprising:

(a) means for calculating a setpoint at a predetermined position relative to a Surge Limit Interface of the turbocompressor, that is a function of a reduced power parameter, $P_r/k_s=P/k_sNP_s$, said Surge Limit Interface comprising the locus of points separating the turbocompressor's stable operating region from its unstable region;

(b) means for calculating an operating point as a function of the reduced power parameter, $P_r/k_s$;

(c) means for comparing the operating point with the setpoint; and (d) means associated with said comparing means for generating a signal corresponding to the position of the turbocompressor's operating point relative to the turbocompressor's surge point.

25. The apparatus of claim 24 wherein the Surge Limit Interface is also a function of another one other parameters ($h_r/k_s$, $q_s^2/k_s$, $R_c$, $\alpha$, or $N_e^2/k_s$).

26. The apparatus of claim 24 wherein the means for calculating an operating point comprises:

(a) means for sensing the power by a power measuring device and generating a power signal proportional to the power;

(b) means for sensing pressure of the turbocompressor by a pressure transmitter, and generating a suction pressure signal proportional to the suction pressure;

(c) means for sensing the rotational speed by a speed measuring device and generating a speed signal proportional to the speed;

(d) means of calculating $P_r$ from the power signal, pressure signal, and the speed signal;

(e) means of calculating $k_s$ as a function of known values; and (f) means of calculating the operating point proportional to the reduced power parameter, $P_r/k_s$.

27. An apparatus for controlling a turbocompressor having a recycle line between its suction and discharge, comprising the steps:

(a) means for calculating a setpoint at a predetermined position relative to the Surge Limit Interface of the turbocompressor that is a function of the reduced power parameter, $P_r/k_s=P/k_sNp_s$, said Surge Limit Interface comprising the locus of points separating the turbocompressor's stable operating region from its unstable region;

(b) means for calculating an operating point as a function of the reduced power parameter, $P_r/k_s$;

(c) means for comparing the turbocompressor's operating point with the Surge Limit Interface for determining the position of the turbocompressor's operating point relative to the turbocompressor's surge point;

(d) means for generating a control signal corresponding to the position of the turbocompressor's operating point relative to the turbocompressor's surge point; and (e) means for modulating flow through the recycle line in response to the control signal so as to avoid surging of the turbocompressor.

28. The apparatus of claim 27 wherein the Surge Limit Interface is also a function of another parameter ($h_r/k_s$, $q_s^2/k_s$, $R_c$, $\alpha$, or $N_e^2/k_s$).

29. The apparatus of claim 27 wherein the means for calculating an operating point comprises:

(a) means for sensing the power by a power measuring device and generating a power signal proportional to the power;

(b) means for sensing suction pressure of the turbocompressor by a pressure transmitter and generating a suction pressure signal proportional to the suction pressure;

(c) means for sensing the rotational speed by a speed measuring device and generating a speed signal proportional to the speed;

(d) means for calculating $P_r$ from the power signal, suction pressure signal, and the speed signal;

(e) means for calculating $k_s$ as a function of known values; and (f) means for calculating the operating point proportional to the reduced power parameter, $P_r/k_s$.

30. An apparatus for controlling a turbocompressor having a recycle line between its suction and discharge, comprising:

(a) means for calculating a setpoint at a predetermined position relative to the Surge Limit Interface for the turbocompressor, that is a function of the reduced power parameter, $P_r/k_s=P/k_sNp_s$, and one more of the following: $h_r/k_s=[(p_d/p_s)^{\sigma}-1]/k_s\sigma)$, $q_s^2/k_s=\Delta p_{o,s}/k_sp_s$, $R_c=p_d/p_s$, $\alpha$, or $N_e^2/k_s=N^2/(kZRT)_s$, said Surge Limit Interface comprising the locus of points separating the turbocompressor's stable operating region from its unstable region;

(b) means for sensing the power by a power measuring device and generating a power signal proportional to the power;

(c) means for sensing the suction pressure of the turbocompressor by a pressure transmitter and generating a suction pressure signal proportional to the suction pressure;

(d) means for sensing the rotational speed by a speed measuring device and generating a speed signal proportional to the speed;

(e) means for calculating $P_r$ from the power signal, suction pressure signal, and the speed signal;

(f) means for calculating ks as a function of known values;

(g) means for calculating a first value proportional to the reduced power parameter, $P_r/k_s$;

(h) means for calculating a value for a second parameter as a function of another one of $h_r/k_s$; $q_s^2/k_s$, $R_c$, $\alpha$, $N_e^2/k_s$;

(i) means for comparing the first value and the second value with the setpoint signal, to generate a control signal corresponding to the position of the turbocompressor's operating point relative to the turbocompressor's surge point; and (j) means for modulating flow in the recycle line in response to the control signal so as to avoid surging of the turbocompressor.

31. The apparatus corresponding to claim 16 wherein the means for calculating a set point comprises:

(a) means for calculating a value proportional to the reduced power parameter, $P_r/k_s$;

(b) means for calculating a value for a second parameter as a function of one of $h_r/k_s$, $q_s^2/k_s$, $R_c$, $\alpha$, or $N_e^2/k_s$;

(c) means for calculating a value for a third parameter as a function of another one of $h_r/k_s$, $q_s^2/k_s$, $R_c$, $\alpha$, or $N_e^2/k_s$; and (d) means for comparing the first value and the second and third values with the setpoint signal, to generate a control signal corresponding to the position of the turbocompressor's operating point relative to the turbocompressor's surge point.

32. The apparatus of claim 30 wherein the means for calculating a first value proportional to the reduced power parameter, $P_r/k_s$, comprises:

(a) means for sensing the power by a power measuring device and generating a power signal proportional to the power;

(b) means for sensing the suction pressure of the turbocompressor by a pressure transmitter, and generating a suction pressure signal proportional to the suction pressure;

(c) means for sensing the rotational speed by a speed measuring device and generating a speed signal proportional to the speed;

(d) means for calculating $k_s$as a function of known values;

(e) means for calculating $P_r=P/Np_s$ from the power signal, suction pressure signal, and the speed signal; and (f) means for generating the first value proportional to the reduced power parameter, $P_r/k_s$.

33. A method for measuring the distance of a turbocompressor's operating point to a Surge Limit Interface of said turbocompressor, said Surge Limit Interface comprising the locus of points separating the turbocompressor's stable operating region from its unstable region, said method comprising the steps of:

(a) determining said Surge Limit Interface for the turbocompressor as a function of a reduced torque parameter, $T_r/k_s=T/k_sp_s$;

(b) calculating a value that indicates the turbocompressor's operating point as a function of the reduced torque parameter, $T_r/k_s$;

(c) comparing the turbocompressor's operating point with said Surge Limit Interface and generating a signal corresponding to the position of the turbocompressor's operating point relative to the turbocompressor's surge point; and (d) controlling the turbocompressor based on said signal.

34. The method of claim 33 wherein the step of comparing the turbocompressor's operating point with the Surge Limit Interface comprises the steps of:

(a) calculating a setpoint at a predetermined position relative to the Surge Limit Interface; and (b) comparing the operating point with the setpoint.

35. The method of claim 33 wherein the Surge Limit Interface is also determined as a function of one of the parameters which include reduced polytropic head ($h_r/k_s$), reduced flow rate ($q_s^2/k_s$), pressure ratio ($R_c$), inlet guide vane position ($\alpha$), and equivalent speed ($N_e^2/k_s$).

36. The method of claim 33 wherein the Surge Limit Interface is also determined as a function of another one of the parameters which include reduced polytropic head ($h_r/k_s$), reduced flow rate ($q_s^2/k_s$), pressure ratio ($R_c$), inlet guide vane position ($\alpha$), and equivalent speed ($N_e^2/k_s$).

37. The method of claim 33 wherein the step of calculating an operating point comprises the steps of:

(a) sensing the torque by a torque measurement device and generating a torque signal proportional to the torque;

(b) sensing the suction pressure of the turbocompressor by a pressure transmitter, and generating a suction pressure signal proportional to the suction pressure;

(c) calculating $T_r=T/p_s$ from the torque signal and the suction pressure signal;

(d) calculating $k_s$ (ratio of specific heats) as a function of known values; and (e) calculating the operating point proportional to the reduced torque parameter, $T_r/k_s$.

38. The method of claim 34 wherein the step of calculating a setpoint comprises the steps of:

(a) plotting the Surge Limit Interface as a function of the reduced torque parameter, $T_r/k_s$, and another one of the following: reduced polytropic head ($h_r/k_s$), reduced flow rate ($q_s^2/k_s$), pressure ratio ($R_c$), inlet guide vane position ($\alpha$), and equivalent speed ($N_e^2/k_s$);

(b) selecting a setpoint reference line; and (c) setting the setpoint on the setpoint reference line at a predetermined position relative to the Surge Limit Interface.

39. The method of claim 38 wherein the step of selecting a setpoint reference line comprises the steps of:

(a) choosing a point on the Surge Limit Interface; and (b) selecting the fine described by this point and the operating point.

40. The method of claim 34 wherein the predetermined position of the setpoint, relative to the Surge Limit Interface, is adjustable during operation of the turbocompressor.

41. A method for controlling a turbocompressor having a recycle line between its suction and discharge comprising the steps of:

(a) determining a Surge Limit Interface for the turbocompressor as a function of a reduced torque parameter, $T_r/k_s=T/k_sp_s$, said Surge Limit Interface comprising the locus of points separating the turbocompressor's stable operating region from its unstable region;

(b) calculating the turbocompressor's operating point as a function of the reduced torque parameter, $T_r/k_s$;

(c) comparing the turbocompressor's operating point with the Surge Limit Interface to determine the position of the turbocompressor's operating point relative to the turbocompressor's surge point;

(d) generating a control signal corresponding to the position of the turbocompressor's operating point relative to the turbocompressor's surge point; and (e) modulating flow through the recycle line in response to the control signal so as to avoid surging the turbocompressor.

42. The method of claim 41 wherein the step of comparing the turbocompressor's operating point with the turbocompressor's surge point comprises the steps of:

(a) calculating a setpoint at a predetermined position relative to the Surge Limit Interface; and (b) comparing the operating point with the setpoint.

43. The method of claim 41 wherein the Surge Limit Interface is determined also as a function of another one of the following: reduced polytropic head ($h_r/k_s$), reduced flow rate ($q_s^2/k_s$), pressure ratio ($R_c$), inlet guide vane position ($\alpha$), and equivalent speed ($N_e^2/k_s$).

44. The method of claim 41 wherein the step of calculating an operating point comprises the steps of:

(a) sensing the torque by a torque measuring device and generating a torque signal proportional to the torque;

(b) sensing the suction pressure of the turbocompressor by a pressure transmitter, and generating a suction pressure signal proportional to the suction pressure;

(c) calculating $k_s$ as a function of known values;

(d) calculating $T_r=T/p_s$ from the torque signal and the suction pressure signal; and (e) calculating the operating point proportional to the reduced torque parameter, $T_r/k_s$.

45. The method of claim 42 wherein the step of calculating a setpoint comprises the steps of:

(a) plotting the Surge Limit Interface as a function of the reduced torque parameter, $T_r/k_s$, and another one of the following: reduced polytropic head ($h_r/k_s$), reduced flow rate ($q_s^2/k_s$), pressure ratio ($R_c$), inlet guide vane position ($\alpha$), and equivalent speed ($N_e^2/k_s$);

(b) selecting a setpoint reference line; and (c) setting the setpoint on the setpoint reference line at a predetermined position relative to the Surge Limit Interface.

46. The method of claim 45 wherein the step of selecting a setpoint reference line comprises the steps of:

(a) choosing a point on the Surge Limit Interface; and (b) selecting the line described by this point and the operating point.

47. The method of claim 42 wherein the predetermined position of the setpoint relative to the Surge Limit Interface is adjustable during operation of the turbocompressor.

48. A method for controlling a turbocompressor having a recycle line between its suction and discharge, comprising the steps of:

(a) determining a Surge Limit Interface for the turbocompressor that is a function of the reduced torque parameter, $T_r/k_s=T/k_sp_s$, and one or more of the following: reduced polytropic head ($h_r/k_s=[(p_d/p_s)^{\sigma}-1]/k_s\sigma$), reduced flow rate ($q_s^2/k_s=\Delta p_{o,s}/k_sp_s$), pressure ratio ($R_c=p_d/p_s$), inlet guide vane position ($\alpha$), and equivalent speed ($N_e^2/k_s=N^2/(kZRT)_s$), said Surge Limit Interface comprising the locus of points separating the turbocompressor's stable operating region from its unstable region;

(b) sensing the torque by a torque measuring device and generating a torque signal proportional to the torque;

(c) sensing the suction pressure of the turbocompressor and generating a suction pressure signal proportional to the suction pressure;

(d) calculating $T_r$ from the torque signal and the suction pressure signal;

(e) calculating $k_s$ as a function of known values;

(f) calculating a value proportional to the reduced torque parameter, $T_r/k_s$;

(g) calculating a value for a second parameter as a function of another one of $h_r/k_s$, $q_s^2/k_s$, $R_c$, $\alpha$, or $N_e^2/k_s$;

(h) comparing the reduced torque parameter, $T_r/k_s$, and the second parameter with the Surge Limit Interface to generate a control signal corresponding to the position of the turbocompressor's operating point relative to the turbocompressor's surge point; and (i) modulating flow in the recycle line in response to the control signal so as to avoid surging of the turbocompressor.

49. The method of claim 48 wherein determination of the Surge Limit Interface comprises the steps of:

(a) calculating a value proportional to the reduced torque parameter, $T_r/k_s$;

(b) calculating a value for a second parameter as a function of one of $h_r/k_s$, $q_s^2/k_s$, $R_c$, (c) calculating a value for a third parameter as a function of another one of $h_r/k_s$; $q_s^2/k_s$; $R_c$, $\alpha$, or $N_e^2/k_s$; and (d) comparing the reduced torque parameter, $T_r/k_s$, and the second and third parameters with the Surge Limit Interface to generate a control signal corresponding to the position of the turbocompressor's operating point relative to the turbocompressor's surge point.

50. The method of claim 48 wherein the step of comparing the reduced torque parameter, $T_r/k_s$, and the other parameters with the Surge Limit Interface comprises the steps of:

(a) establishing a setpoint reference line;

(b) selecting a setpoint on the setpoint reference line at a predetermined position relative to the Surge Limit Interface;

(c) calculating a value representing the operating point to the turbocompressor along the setpoint reference line; and (d) comparing the operating point with the setpoint.

51. The method of claim 50 wherein the step of selecting a setpoint reference line comprises the steps of:

(a) choosing a point on the Surge Limit Interface; and (b) selecting the line described by this point and the operating point.

52. The method of claim 48 wherein the step of calculating a value proportional to the reduced torque parameter, $T_r/k_s$, comprises the steps of:

(a) dividing the suction pressure signal into the torque signal to generate a $T/p_s$ value which is proportional to $T_r$;

(b) calculating $k_s$ from known values; and (c) dividing $T_r$ by $k_s$ to generate a value which is proportional to the reduced torque parameter, $T_r/k_s$.

53. The method of claim 49 wherein the step of comparing the reduced torque parameter, $T_r/k_s$, and the other parameters with the Surge Limit Interface comprises the steps of:

(a) calculating a setpoint at a predetermined position relative to the Surge Limit Interface;

(b) generating an operating point that is a function of the reduced torque parameter, $T_r/k_s$, and the other parameters; and (c) comparing the operating point with the setpoint.

54. The method of claim 53 wherein the operating point is a function of the ratio of the reduced torque parameter, $T_r/k_s$, to the other parameters, multiplied by a function of the third parameter.

55. The method of claim 54 wherein the operating point is the reduced torque parameter, $T_r/k_s$, divided by the second parameter, multiplied by a function of the third parameter minus one, the second value modified to properly characterize the first signal in relation to the Surge Limit Interface.

56. An apparatus for determining the position of a turbocompressor's operating point relative to the turbocompressor's surge point, comprising:

(a) means for calculating a setpoint at a predetermined position relative to a Surge Limit Interface of the turbocompressor, that is a function of a reduced torque parameter, $T_r/k_s=T/k_sp_s$, said Surge Limit Interface comprising the locus of points separating the turbocompressor's stable operating region from its unstable region;

(b) means for calculating an operating point as a function of the reduced torque parameter, $T_r/k_s$;

(c) means for comparing the operating point with the setpoint; and (d) means associated with said comparing means for generating a signal corresponding to the position of the turbocompressor's operating point relative to the turbocompressor's surge point.

57. The apparatus of claim 56 wherein the Surge Limit Interface is also a function of another one of ($h_r/k_s$, $q_s^2/k_s$, $R_c$, $\alpha$, or $N_e^2/k_s$).

58. The apparatus of claim 56 wherein the means for calculating an operating point comprises:

(a) means for sensing the torque by a torque measuring device and generating a torque signal proportional to the torque;

(b) means for sensing pressure of the turbocompressor by a pressure transmitter, and generating a suction pressure signal proportional to the suction pressure;

(c) means for calculating $T_r$ from the torque signal and the suction pressure signal;

(d) means for calculating $k_s$ as a function of known values; and (e) means for calculating the operating point proportional to the reduced torque parameter, $T_r/k_s$.

59. An apparatus for controlling a turbocompressor having a recycle line between its suction and discharge, comprising the steps:

(a) means for calculating a setpoint at a predetermined position relative to the Surge Limit Interface of the turbocompressor that is a function of the reduced torque parameter, $T_r/k_s=T/k_sp_s$, said Surge Limit Interface comprising the locus of points separating the turbocompressor's stable operating region from its unstable region;

(b) means for calculating an operating point as a function of the reduced torque parameter, $T_r/k_s$;

(c) means for comparing the turbocompressor's operating point with the Surge Limit Interface for determining the position of the turbocompressor's operating point relative to the turbocompressor's surge point;

(d) means for generating a control signal corresponding to the position of the turbocompressor's operating point relative to the turbocompressor's surge point; and (e) means for modulating flow through the recycle line in response to the control signal so as to avoid surging the turbocompressor.

60. The apparatus of claim 59 wherein the Surge Limit Interface is also a function of another parameter ($h_r/k_s$, $q_s^2/k_s$; $R_c$, $\alpha$, or $N_e^2/k_s$).

61. The apparatus of claim 59 wherein the means for calculating an operating point comprises:

(a) means for sensing the torque by a torque measuring device and generating a torque signal proportional to the torque;

(b) means for sensing the suction pressure of the turbocompressor by a pressure transmitter and generating a suction pressure signal proportional to the suction pressure;

(c) means for calculating $T_r$ from the torque signal and the suction pressure signal;

(d) means for calculating $k_s$ as a function of known values; and (e) means for calculating the operating point proportional to the reduced torque parameter, $T_r/k_s$.

62. An apparatus for controlling a turbocompressor having a recycle line between its suction and discharge, comprising:

(a) means for calculating a setpoint at a predetermined position relative to the Surge Limit Interface for the turbocompressor, that is a function of the reduced torque parameter, $T_r/k_s=T/k_sp_s$, and one more of the following parameters: $h_r/k_s=[(p_d/p_s)^{\sigma}-1]/k_s\sigma$, $q_s^2/k_s=\Delta p_{o,s}/k_sp_s$, $R_c=p_d/p_s$, $\alpha$, or $N_e^2/k_s=N^2/(kZRT)_s$, said Surge Limit Interface comprising the locus of points separating the turbocompressor's stable operating region from its unstable region;

(b) means for sensing the torque by a torque measuring device and generating a torque signal proportional to the torque;

(c) means for sensing the suction pressure of the turbocompressor by a pressure transmitter and generating a suction pressure signal proportional to the suction pressure;

(d) means for calculating $T_r$ from the torque signal and suction pressure signal;

(e) means for calculating $k_s$ as a function of known values;

(f) means for calculating a first value proportional to the reduced torque parameter, $T_r/k_s$;

(g) means for calculating a value for a second parameter as a function of another one of $h_r/k_s$, $q_s^2/k_s$, $R_c$, $\alpha$, $N_e^2/k_s$;

(h) means for comparing the first value and the second value with the setpoint signal, to generate a control signal corresponding to the position of the turbocompressor's operating point relative to the turbocompressor's surge point; and (i) means for modulating flow in the recycle line in response to the control signal so as to avoid surging of the turbocompressor.

63. The apparatus of claim 62 wherein the means for calculating the setpoint comprises:

(a) calculating a value proportional to the reduced torque parameter, $T_r/k_s$;

(b) calculating a value for a second parameter as a function of one of $h_r/k_s$, $q^2/k_s$, $R_c$, $\alpha$, or $N_e^2/k_s$;

(c) calculating a value for a third parameter as a function of another one of $h_r/k_s$, $q_s^2/k_s$, $R_c$, $\alpha$, or $N_e^2/k_s$; and (d) a means for comparing the first value and the second and third values with the setpoint signal, to generate a control signal corresponding to the position of the turbocompressor's operating point relative to the turbocompressor's surge point.

64. The apparatus of claim 62 wherein the means for calculating a first value proportional to the reduced torque parameter, $T_r/k_s$, comprises:

(a) means for sensing the torque by a torque measuring device and generating a torque signal proportional to the torque;

(b) means for sensing the suction pressure of the turbocompressor by a pressure transmitter, and generating a suction pressure signal proportional to the suction pressure;

(c) means for calculating $k_s$ as a function of known values;

(d) means for calculating $T_r=T/P_s$ from the torque signal and the suction pressure signal; and (e) means for generating the first value proportional to the reduced torque parameter, $T_r/k_s$.

65. A method for measuring the distance of a turbocompressor's operating point to a Surge Limit Interface of said turbocompressor, said Surge Limit Interface comprising the locus of points separating the turbocompressor's stable operating region from its unstable region, said method comprising the steps of:

(a) determining said Surge Limit Interface for the turbocompressor as a function of an equivalent speed parameter, $N_e^2/k_s=N^2/(kZRT)_s$;

(b) calculating a value that indicates the turbocompressor's operating point as a function of the equivalent speed parameter, $N_e^2/k_s$;

(c) comparing the turbocompressor's operating point with said Surge Limit Interface and generating a signal corresponding to the position of the turbocompressor's operating point relative to the turbocompressor's surge point; and (d) controlling the turbocompressor based on said signal.

66. The method of claim 65 wherein the step of comparing the turbocompressor's operating point with the Surge Limit Interface comprises the steps of:

(a) calculating a setpoint at a predetermined position relative to the Surge Limit Interface; and (b) comparing the operating point with the setpoint.

67. The method of claim 65 wherein the Surge Limit Interface is also determined as a function of one of several parameters which include reduced polytropic head ($h_r/k_s$), reduced flow rate ($q_s^2/k_s$), pressure ratio ($R_c$), inlet guide vane position ($\alpha$), reduced power ($P_r/k_s$), and reduced torque ($T_r/k_s$).

68. The method of claim 65 wherein the step of calculating an operating point comprises the steps of:

(a) sensing the temperature by a temperature measurement device and generating a temperature signal proportional to the temperature;

(b) sensing the rotational speed by a speed measuring device and generating a speed signal proportional to the speed;

(c) squaring the speed signal;

(d) dividing compressibility and the temperature signal into the square of the speed signal and multiplying by molecular weight to calculate a value proportional to $N_e^2$;

(e) calculating $k_s$ (ratio of specific heats) as a function of known values; and (f) calculating an operating point proportional to the equivalent speed parameter, $N_e^2/k_s$.

69. The method of claim 66 wherein the step of calculating a setpoint comprises the steps of:

(a) plotting the Surge Limit Interface as a function of the equivalent speed parameter, $N_e^2/k_s$, as a function of another one of the following: reduced polytropic head ($h_r/k_s$), reduced flow rate ($q_s^2/k_s$), pressure ratio ($R_c$), inlet guide vane position ($\alpha$), reduced power ($P_r/k_s$), and reduced torque ($T_r/k_s$);

(b) selecting a setpoint reference line; and (c) setting the setpoint on the setpoint reference line at a predetermined position relative to the Surge Limit Interface.

70. The method of claim 69 wherein the step of selecting a setpoint reference line comprises the steps of:

(a) choosing a point on the Surge Limit Interface; and (b) selecting the line described by this point and the operating point.

71. The method of claim 66 wherein the predetermined position of the setpoint, relative to the Surge Limit Interface, is adjustable during operation of the turbocompressor.

72. A method for controlling a turbocompressor having a recycle line between its suction and discharge comprising the steps of:

(a) determining a Surge Limit Interface for the turbocompressor as a function of an equivalent speed parameter, $N_e^2/k_s=N^2/(kZRT)_s$, said Surge Limit Interface comprising the locus of points separating the turbocompressor's stable operating region from its unstable region;

(b) calculating the turbocompressor's operating point as a function of the equivalent speed parameter, $N_e^2/k_s$;

(c) comparing the turbocompressor's operating point with the Surge Limit Interface to determine the position of the turbocompressor's operating point relative to the turbocompressor's surge point;

(d) generating a control signal corresponding to the position of the turbocompressor's operating point relative to the turbocompressor's surge point; and (e) modulating flow through the recycle line in response to the control signal so as to avoid surging of the turbocompressor.

73. The method of claim 72 wherein the step of comparing the turbocompressor's operating point with the turbocompressor's surge point comprises the steps of:

(a) calculating a setpoint at a predetermined position relative to the Surge Limit Interface; and (b) comparing the operating point with the setpoint.

74. The method of claim 72 wherein the Surge Limit Interface is determined also as a function of another one of the following: reduced polytropic head ($h_r/k_s$), reduced flow rate ($q_s^2/k_s$), pressure ratio ($R_c$), inlet guide vane position ($\alpha$), reduced power ($P_r/k_s$), and reduced torque ($T_r/k_s$).

75. The method of claim 72 wherein the step of calculating an operating point comprises the steps of:

(a) sensing the temperature by a temperature measurement device and generating a temperature signal proportional to the temperature;

(b) sensing the rotational speed by a speed measuring device and generating a speed signal proportional to the speed;

(c) squaring the speed signal;

(d) dividing compressibility and the temperature signal into the square of the speed signal and multiplying by molecular weight to calculate a value proportional to $N_e^2$;

(e) calculating $k_s$ as a function of known values; and (f) calculating an operating point proportional to the equivalent speed parameter, $N_e^2/k_s$.

76. The method of claim 73 wherein the step of calculating a setpoint comprises the steps of:

(a) plotting the Surge Limit Interface as a function of the equivalent speed parameter, $N_e^2/k_s$, as a function of another one of the following: reduced polytropic head ($h_r/k_s$), reduced flow rate ($q_s^2/k_s$), pressure ratio ($R_c$), inlet guide vane position ($\alpha$), reduced power ($P_r/k_s$), and reduced torque ($T_r/k_s$);

(b) selecting a setpoint reference line; and (c) setting the setpoint on the setpoint reference line at a predetermined position relative to the Surge Limit Interface.

77. The method of claim 76 wherein the step of selecting a setpoint reference line comprises the steps of:

(a) choosing a point on the Surge Limit Interface; and (b) selecting the line which is described by setting these parameters to these values.

78. The method of claim 73 wherein the predetermined position of the setpoint relative to the Surge Limit Interface is adjustable during operation of the turbocompressor.

79. A method for controlling a turbocompressor having a recycle line between its suction and discharge, comprising the steps of:

(a) determining a Surge Limit Interface for the turbocompressor that is a function of the equivalent speed parameter, $N_e^2/k_s=N^2/(kZRT)_s$, and one or more of the following: reduced polytropic head ($h_r/k_s=[(p_d/p_s)^{\sigma}-1]/k_s\sigma$), reduced flow rate ($q_s^2/k_s=\Delta p_{o,s}/k_s p_s$), pressure ratio ($R_c=p_d/p_s$), inlet guide vane position ($\alpha$), reduced power ($P_r/k_s=P/k_s N p_s$), and reduced torque ($T_r/k_s=T/k_s p_s$), said Surge Limit Interface comprising the locus of points separating the turbocompressor's stable operating region from its unstable region;

(b) sensing the temperature by a temperature measurement device and generating a temperature signal proportional to the temperature;

(c) sensing the rotational speed by a speed measuring device and generating a speed signal proportional to the speed;

(d) squaring the speed signal;

(e) dividing compressibility and the temperature signal into the square of the speed signal and multiplying by molecular weight to calculate a value proportional to $N_e^2$;

(f) calculating $k_s$ as a function of known values;

(g) calculating a value proportional to the equivalent speed parameter, $N_e^2/k_s$;

(h) calculating a value for a second parameter as a function of another one of $h_r/k_s$, $q_s^{2/k}{}_s$, $R_c$, $\alpha$, $P_r/k_s$, or $T_r/k_s$;

(i) comparing the equivalent speed parameter, $N_e^2/k_s$, and the second parameter with the Surge Limit Interface to generate a control signal corresponding to the position of the turbocompressor's operating point relative to the turbocompressor's surge point; and (j) modulating flow in the recycle line in response to the control signal so as to avoid surging of the turbocompressor.

80. The method of claim 79 wherein determination of the Surge Limit Interface comprises the steps of:

(a) calculating a value proportional to the equivalent speed parameter, $N_e^2/k_s$;

(b) calculating a value for a second parameter as a function of one of $h_r/k_s$, $q_s^2/k_s$, $R_c$, $\alpha$, $P_r/k_s$, or $T_r/k_s$;

(c) calculating a value for a third parameter as a function of another one of $h_r/k_s$, $q_s^2/k_s$, $R_c$, $\alpha$, $P_r$, or $T_r/k_s$; and (d) comparing the equivalent speed parameter, $N_e^2/k_s$, and the second and third parameters with the Surge Limit Interface to generate a control signal corresponding to the position of the turbocompressor's operating point relative to the turbocompressor's surge point.

81. The method of claim 79 wherein the step of comparing the equivalent speed parameter, $N_e^2/k_s$, arid the other parameters with the Surge Limit Interface comprises the steps of:

(a) establishing a setpoint reference line;

(b) selecting a setpoint on the setpoint reference line at a predetermined position relative to the Surge Limit Interface;

(c) calculating a value representing the operating point to the turbocompressor along the setpoint reference line; and (d) comparing the operating point with the setpoint.

82. The method of claim 81 wherein the step of selecting a setpoint reference line comprises the steps of:

(a) choosing a point on the Surge Limit Interface; and (b) selecting the line described by this point and the operating point.

83. The method of claim 79 wherein the step of calculating a value proportional to the equivalent speed parameter, $N_e^2/k_s$, comprises the steps of:

(a) squaring the speed signal;

(b) dividing compressibility and the temperature signal into the square of the speed signal and multiplying by molecular weight to calculate a value proportional to $N_e^2$;

(c) calculating $k_s$ as a function of known values; and (d) dividing $N_e^2$by $k_s$ to generate a value which is proportional to the equivalent speed parameter, $N_e^2/k_s$,

84. The method of claim 79 wherein the step of comparing the equivalent speed parameter, $N_e^2/k_s$, and the other parameters with the Surge Limit Interface comprises the steps of:

(a) calculating a setpoint at a predetermined position relative to the Surge Limit Interface;

(b) generating an operating point that is a function of the equivalent speed parameter, $N_e^2/k_s$, and the other parameters; and (c) comparing the operating point with the setpoint.

85. The method of claim 84 wherein the operating point is a function of the ratio of the equivalent speed parameter, $N_e^2/k_s$, to the second parameter, multiplied by a function of the third parameter.

86. The method of claim 85 wherein the operating point is the equivalent speed parameter, $N_e^2/k_s$, divided by the second parameter, multiplied by a function of the third parameter minus one, the first two values modified to properly characterize the first signal in relation to the Surge Limit Interface.

87. An apparatus for determining the position of a turbocompressor's operating point relative to the turbocompressor's surge point, comprising:

(a) means for calculating a setpoint at a predetermined position relative to a Surge Limit Interface of the turbocompressor, that is a function of an equivalent speed parameter, $N_e^2/k_s=N^2/(kZRT)_s$, said Surge Limit Interface comprising the locus of points separating the turbocompressor's stable operating region from its unstable region;

(b) means for calculating an operating point as a function of the equivalent speed parameter, $N_e^2/k_s$;

(c) a means for comparing the operating point with the setpoint; and (d) means associated with said comparing means for generating a signal corresponding to the position of the turbocompressor's operating point relative to the turbocompressor's surge point.

88. The apparatus of claim 87 wherein the Surge Limit Interface is also a function of another one of $h_r/k_s$, $q_s^2/k_s$, $R_c$, $\alpha$, $P_r/k_s$, or $T_r/k_s$.

89. The apparatus of claim 87 wherein the means for calculating an operating point comprises:

(a) means for sensing the temperature by a temperature measurement device and generating a temperature signal proportional to the temperature;

(b) means for sensing the rotational speed by a speed measuring device and generating a speed signal proportional to the speed;

(c) means for squaring the speed signal;

(d) means for dividing compressibility and the temperature signal into the square of the speed signal and multiplying by molecular weight to calculate a value proportional to $N_e^2$;

(e) means of calculating $k_s$ as a function of known values; and (f) means of calculating the operating point proportional to the equivalent speed parameter, $N_e^2/k_s$.

90. An apparatus for controlling a turbocompressor having a recycle line between its suction and discharge, comprising the steps:

(a) means for calculating a setpoint at a predetermined position relative to the Surge Limit Interface of the turbocompressor that is a function of the equivalent speed parameter, $N_e^2/k_s=N^2/(kZRT)_s$, said Surge Limit Interface comprising the locus of points separating the turbocompressor's stable operating region from its unstable region;

(b) means for calculating an operating point as a function of the equivalent speed parameter, $N_e^2/k_s$;

(c) means for comparing the turbocompressor's operating point with the Surge Limit Interface for determining the position of the turbocompressor's operating point relative to the turbocompressor's surge point;

(d) means for generating a control signal corresponding to the position of the turbocompressor's operating point relative to the turbocompressor's surge point; and (e) means for modulating flow through the recycle line in response to the control signal so as to avoid surging of the turbocompressor.

91. The apparatus of claim 90 wherein the Surge Limit Interface is also a function of another parameter ($h_r/k_s$, $q_s^2/k_s$, $R_c$, $\alpha$, $P_r/k_s$, or $T_r/k_s$.

92. The apparatus of claim 90 wherein the means for calculating an operating point comprises:

(a) means for sensing the temperature by a temperature measurement device and generating a temperature signal proportional to the temperature;

(b) means for sensing the rotational speed by a speed measuring device and generating a speed signal proportional to the speed;

(c) means for squaring the speed signal;

(d) means for dividing compressibility and the temperature signal into the square of the speed signal and multiplying by molecular weight to calculate $N_e^2$;

(e) means for calculating $k_s$ as a function of known values; and (f) means for calculating the operating point proportional to the equivalent speed parameter, $N_e^2/k_s$.

93. An apparatus for controlling a turbocompressor having a recycle line between its suction and discharge, comprising:

(a) means for calculating a setpoint at a predetermined position relative to the Surge Limit Interface for the turbocompressor, that is a function of the equivalent speed parameter, $N_e^2/k_s=N^2/(kZRT)$, and one or more of the following parameters: $h_r/k_s=[(p_d/p_s)^{\sigma}-1]/k_s\sigma$, $q_s^2/k_s=\Delta p_{o,s}/k_s p_s$, $R_c=p_d/p_s$, $\alpha$, $P_r/k_s=P/k_s N p_s$, or $T_r/k_s=T/k_s\, p_s$, said Surge Limit Interface comprising the locus of points separating the turbocompressor's stable operating region from its unstable region;

(b) means for sensing the temperature by a temperature measurement device and generating a temperature signal proportional to the temperature;

(c) means for sensing the rotational speed by a speed measuring device and generating a speed signal proportional to the speed;

(d) means for squaring the speed signal;

(e) means for dividing compressibility and the temperature signal into the square of the speed signal and multiplying by molecular weight to calculate $N_e^2$;

(f) means for calculating $k_s$ as a function of known values;

(g) means for calculating a first value proportional to the equivalent speed parameter, $N_e^2/k_s$;

(h) means for calculating a value for a second parameter as a function of another one of $h_r/k_s$, $q_s^2/k_s$, $R_c$, $\alpha$, $P_r/k_s$, or $T_r/k_s$;

(i) means for comparing the first value and the second value with the setpoint signal, to generate a control signal corresponding to the position of the turbocompressor's operating point relative to the turbocompressor's surge point; and (j) means for modulating flow in the recycle line in response to the control signal so as to avoid surging the turbocompressor.

94. The apparatus of claim 93 wherein said means for calculating the setpoint comprises:

(a) means for calculating a value proportional to the equivalent speed parameter, $N_e^2/k_s$;

(b) means for calculating a value for a second parameter as a function of another one of $h_r/k_s$, $q_s^2/k_s$, $R_c$, $\alpha$, $P_r/k_s$, or $T_r/k_s$;

(c) means for calculating a value for a third parameter as a function of another one of $h_r/k_s$, $q_s^2/k_s$; $R_c$, $\alpha$, $P_r/k_s$, or $T_r/k_s$; and (d) means for comparing the first value and the second and third values with the setpoint signal, to generate a control signal corresponding to the position of the turbocompressor's operating point relative to the turbocompressor's surge point.

95. The apparatus of claim 93 wherein the means for calculating a first value proportional to the equivalent speed parameter, $N_e^2/k_s$, comprises:

(a) means for sensing the temperature by a temperature measurement device and generating a temperature signal proportional to the temperature;

(b) means for sensing the rotational speed by a speed measuring device and generating a speed signal proportional to the speed;

(c) means for squaring the speed signal;

(d) means for dividing compressibility and the temperature signal into the square of the speed signal and multiplying by molecular weight to calculate $N_e^2$;

(e) means for calculating $k_s$ as a function of known values;

(f) means for calculating $N_e^2=N^2MW/ZR_uT$ from the temperature signal, speed signal, compressibility and molecular weight; and (g) means for generating the first value proportional to the equivalent speed parameter, $N_e^2/k_s$.

96. A method for measuring the distance of a turbocompressor's operation point to a Surge Limit Interface of said turbocompressor, said Surge Limit Interface comprising the locus of points separating the turbocompressor's stable operation region from its unstable region, said method comprising the steps of:

(a) determining said Surge Limit Interface for the turbocompressor as a function of a parameter of the turbocompressor selected from reduced power, $P_r=P/Np_s$, reduced torque, $T_r=T/p_s$, and equivalent speed, $N_e^2=N^2/(kZRT)_s$;

(b) calculating a value that indicates the turbocompressor's operating point as a function of the selected parameter;

(c) comparing the turbocompressor's operating point with the Surge Limit Interface;

(d) generating a signal corresponding to the position of the turbocompressor's operating point relative to the turbocompressor's surge point; and (e) controlling the turbocompressor based on said signal.

* * * * *

UNITED STATES PATENT AND TRADEMARK OFFICE

CERTIFICATE OF CORRECTION

PATENT NO. : 5,508,943

DATED : April 16, 1996

INVENTOR(S) : Brett W. Batson, et al.

It is certified that error appears in the above-indentified patent and that said Letters Patent is hereby corrected as shown below:

In the Abstract at column 2, line 12 delete "T" and insert --T--.

at column 2, line 56, and line 58 delete "T" and insert --T--.

at column 5, line 4, line 13 (first equation - 2 occurences), and line 34, delete "T" and insert --T--.

at column 12, line 21 (2 occurrences), line 24, line 57 (2 occurences), line 63, and line 67 delete "T" and insert --T--.

at column 13, line 21 (2 occurrences), line 25, line 56 (2 occurrences), line 60, and line 64 delete "T" and insert --T--.

at column 14, line 18 (2 occurrences), line 31, line 35, line 38, line 49, line 55, and line 61, delete "T" and insert --T--.

at column 15, line 12, line 14, line 15, line 17, line 18, line 20, line 25, line 30, line 33, line 43 (2 occurrences), and line 48 delete "T" and insert --T--.

at column 16, line 1, line 6, line 13 (2 occurrences), line 18, line 41, line 46, and line 55 (2 occurrences), delete "T" and insert --T--.

at column 17, line 1, line 6, line 21, line 33, line 45 (2 occurrences), and line 46, delete "T" and insert --T--.

at column 18, line 12, and line 39, delete "T" and insert --T--.

at column 19, line 17, line 43, and line 68 (2 occurrences), delete "T"

UNITED STATES PATENT AND TRADEMARK OFFICE

CERTIFICATE OF CORRECTION

PATENT NO. : 5,508,943

DATED : April 16, 1996

INVENTOR(S) : Brett W.Batson, et al.

It is certified that error appears in the above-indentified patent and that said Letters Patent is hereby corrected as shown below:

and insert --T--.

at column 20, line 19, line 33, and line 35, delete "T" and insert --T--.

at column 21, line 43, delete "T" and insert --T--.

at column 22, line 20, line 47, line 48, and line 66, delete "T" and insert --T--.

at column 23, line 16, and line 19, delete "T" and insert --T--.

at column 24, line 22 (2 occurrences), delete "T" and insert --T--.

at column 5, line 35 delete ":" after the word *exponent* and insert --:--.

at column 5, line 38, line 39, and line 42, delete "P" and insert --p--.

at column 5, line 46, delete "R" and insert --$R_u$--.

at column 5, line 61, delete "inventions" and insert --invention--.

at column 8, line 56, delete"$P_r$/ks" and insert --$P_r/k_s$--.

at column 9, line 2, delete "$q_s^2k_s$" and insert --$q_s^2/k_s$--.

at column 9, line 64, delete"$P_r/k_s=P/k_sNP_s$," and insert --$P_r/k_s=P/k_sNp_s$,--.

UNITED STATES PATENT AND TRADEMARK OFFICE

CERTIFICATE OF CORRECTION

PATENT NO. : 5,508,943

DATED : April 16, 1996

INVENTOR(S) : Brett W. Batson, et al.

It is certified that error appears in the above-indentified patent and that said Letters Patent is hereby corrected as shown below:

at column 11, line 32, delete "ks" and insert --$k_s$--.

at column 11, line 37, delete"$h_r/k_s$; $q_s^2/k_s$, $R_c$, $\alpha$, $N_e^2/k_s$;" and insert --$h_r/k_s$, $q_s^2/k_s$, $R_c$, $\alpha$, $N_e^2/k_s$;--.

at column 13, line 11, delete "fine" and insert --line--.

at column 14, line 51, delete"$h_r/k_s$, $q_s^2/k_s$, $R_c$," and insert --$h_r/k_s$, $q_s^2/k_s$, $R_c$, $\alpha$, or $N_e^2/k_s$;--.

at column 14, line 53, delete "$h_r/k_s$; $q_s^2/k_s$; $R_c$, $\alpha$, or $N_e^2/k_s$;" and insert --$h_r/k_s$, $q_s^2/k_s$, $R_c$, $\alpha$, or $N_e^2/k_s$;--.

at column 16, line 30-31, delete "($h_r/k_s$, $q_s^2/k_s$; $R_c$, $\alpha$, or $N_e^2/k_s$)." and insert --($h_r/k_s$, $q_s^2/k_s$, $R_c$, $\alpha$, or $N_e^2/k_s$).--.

at column 20, line 18-19, delete "$h_r/k_s$, $q_s^{2/k}{}_s$, $R_c$, $\alpha$, $P_r/k_s$, or $T_r/k_s$;" and insert --$h_r/k_s$, $q_s^2/k_s$, $R_c$, $\alpha$, $P_r/k_s$, or $T_r/k_s$;--.

at column 20, line 43, delete "arid" and insert --and--.

at column 22, line 20, delete "($h_r/k_s$, $q_s^2/k_s$, $R_c$, $\alpha$, $P_r/k_s$, or $T_r/k_s$." and insert --($h_r/k_s$, $q_s^2/k_s$, $R_c$, $\alpha$, $P_r/k_s$, or $T_r/k_s$).--.

at column 23, line 17-18, delete "$h_r/k_s$, $q_s^2/k_s$; $R_c$, $\alpha$, $P_r/k_s$, or $T_r/k_s$;" and insert --$h_r/k_s$, $q_s^2/k_s$, $R_c$, $\alpha$, $P_r/k_s$, or $T_r/k_s$;--.

UNITED STATES PATENT AND TRADEMARK OFFICE

CERTIFICATE OF CORRECTION

PATENT NO. : 5,508,943

DATED : April 16, 1996

INVENTOR(S) : Brett W. Batson, et al.

It is certified that error appears in the above-indentified patent and that said Letters Patent is hereby corrected as shown below:

at column 20, line 18-19, delete "$h_r/k_s$, $q_s^{2/k}{}_s$, $R_c$, $\alpha$, $P_r/k_s$, or $T_r/k_s$;" and insert --$h_r/k_s$, $q_s^2/k_s$, $R_c$, $\alpha$, $P_r/k_s$, or $T_r/k_s$;--.

at column 20, line 43, delete "arid" and insert --and--.

at column 22, line 20, delete "($h_r/k_s$, $q_s^2/k_s$, $R_c$, $\alpha$, $P_r/k_s$, or $T_r/k_s$." and insert --($h_r/k_s$, $q_s^2/k_s$, $R_c$, $\alpha$, $P_r/k_s$, or $T_r/k_s$).--.

at column 23, line 17-18, delete "$h_r/k_s$, $q_s^2/k_s$; $R_c$, $\alpha$, $P_r/k_s$, or $T_r/k_s$;" and insert --$h_r/k_s$, $q_s^2/k_s$, $R_c$, $\alpha$, $P_r/k_s$, or $T_r/k_s$;--.

Signed and Sealed this

Tenth Day of September, 1996

*Attest:*

*Attesting Officer*

BRUCE LEHMAN

*Commissioner of Patents and Trademarks*